US008826605B2

(12) United States Patent
Recker et al.

(10) Patent No.: US 8,826,605 B2
(45) Date of Patent: Sep. 9, 2014

(54) LIFTING AND BRACING SYSTEM FOR A WALL PANEL

(71) Applicants: Michael J. Recker, Lithia, FL (US); James Zachery Petersen, Riverview, FL (US); Randy Lance Osborne, Valrico, FL (US)

(72) Inventors: Michael J. Recker, Lithia, FL (US); James Zachery Petersen, Riverview, FL (US); Randy Lance Osborne, Valrico, FL (US)

(73) Assignee: Oldcastle Precast, Inc., Auburn, WA (US)

( * ) Notice: Subject to any disclaimer, the term of this patent is extended or adjusted under 35 U.S.C. 154(b) by 0 days.

(21) Appl. No.: 14/046,730

(22) Filed: Oct. 4, 2013

(65) Prior Publication Data

US 2014/0096459 A1 Apr. 10, 2014

Related U.S. Application Data

(60) Provisional application No. 61/710,215, filed on Oct. 5, 2012.

(51) Int. Cl.

| | |
|---|---|
| ***E02D 35/00*** | (2006.01) |
| ***E04G 21/14*** | (2006.01) |
| ***E04H 12/34*** | (2006.01) |
| ***E04B 1/41*** | (2006.01) |

(52) U.S. Cl.

CPC ..... *E04G 21/147* (2013.01); *E04B 1/41* (2013.01)

USPC ..... 52/125.5; 52/699; 52/704

(58) Field of Classification Search

CPC ..... E04G 21/142; E04G 21/185; E04G 15/04; E04B 1/41; E04B 1/3511; E04B 1/4157; E04B 1/4121; B66C 1/666; B66C 1/66

USPC ..... 52/125.1–125.5, 126.4, 699, 704, 707

See application file for complete search history.

(56) References Cited

U.S. PATENT DOCUMENTS

| | | | | |
|---|---|---|---|---|
| 2,099,116 | A * | 11/1937 | Kalmach | 294/103.1 |
| 3,798,856 | A | 3/1974 | Gloskowski | |
| 4,083,156 | A | 4/1978 | Tye | |
| 4,173,856 | A | 11/1979 | Fricker | |
| 4,383,674 | A | 5/1983 | Fricker | |
| 4,437,642 | A | 3/1984 | Holt | |
| 4,615,554 | A * | 10/1986 | Schilla et al. | 294/89 |
| 4,634,164 | A | 1/1987 | Fricker | |
| 4,671,554 | A | 6/1987 | Lancelot | |
| 4,700,979 | A | 10/1987 | Courtois et al. | |
| 4,703,595 | A * | 11/1987 | Zipf et al. | 52/125.4 |
| 4,769,960 | A * | 9/1988 | Zipf et al. | 52/125.4 |
| 4,821,994 | A | 4/1989 | Fricker | |
| 4,872,634 | A | 10/1989 | Gillaspy et al. | |
| 5,094,047 | A | 3/1992 | Kelly et al. | |
| 5,155,954 | A * | 10/1992 | Roire | 52/125.5 |
| 5,535,979 | A | 7/1996 | Ellis-Callow | |
| 5,580,115 | A * | 12/1996 | Jessen | 294/89 |
| 5,651,911 | A | 7/1997 | Pennypacker | |
| 6,082,700 | A | 7/2000 | Lancelot, III et al. | |
| 6,142,546 | A | 11/2000 | Hansort | |
| 6,152,509 | A * | 11/2000 | Hansort | 294/89 |

(Continued)

*Primary Examiner* — Brian Glessner
*Assistant Examiner* — Brian D Mattei
(74) *Attorney, Agent, or Firm* — Sheridan Ross P.C.

(57) ABSTRACT

A connector member and system is provided for selectively connecting to an anchor of a precast concrete structure. The connector member comprises arcuate members for rotating the anchor into a position of secure interconnection and serves as a force-transmitting device for contacting the anchor and associated features and structures.

17 Claims, 6 Drawing Sheets

(56) References Cited

U.S. PATENT DOCUMENTS

| | | | | |
|---|---|---|---|---|
| 6,260,900 | B1 | 7/2001 | Scott | |
| 6,341,452 | B1 * | 1/2002 | Bollinghaus | 52/125.5 |
| 6,769,663 | B2 | 8/2004 | Kelly et al. | |
| 7,905,063 | B2 | 3/2011 | Kelly | |
| 7,950,190 | B2 | 5/2011 | Schulze | |
| 2009/0320386 | A1 * | 12/2009 | Mackay Sim | 52/125.4 |
| 2012/0073170 | A1 * | 3/2012 | Boltz et al. | 40/603 |
| 2013/0340357 | A1 | 12/2013 | Recker et al. | |

* cited by examiner

SECTION M-M

LIFTING AND BRACING SYSTEM FOR A WALL PANEL

This U.S. Non-Provisional patent application claims the benefit of priority from U.S. Provisional Patent Application Ser. No. 61/710,215 filed Oct. 5, 2012, the entire disclosure of which is hereby incorporated by reference in its entirety.

FIELD OF THE INVENTION

Embodiments of the present disclosure are generally related to systems, methods and devices for attaching to lifting anchors. More specifically, embodiments of the present disclosure relate to methods and devices for connecting to a pre-installed insert or anchor bolt associated with a wall panel or building component.

BACKGROUND OF THE INVENTION

Certain pre-installed members for transmitting force and manipulating panels or structures, such as pre-formed concrete panels, are known in the art. Prior art systems comprise, for example, a void former or recessing member as shown and described in U.S. Pat. No. 7,905,063 to Kelly, which is hereby incorporated by reference in its entirety. Such devices are generally provided to create a void or point of access in, for example, a precast concrete panel or wall structure which generally provides access to an anchor member embedded within the concrete panel for aiding in manipulation and/or movement of the panel.

SUMMARY OF THE INVENTION

Accordingly, it is one aspect of the present invention to provide a system for selectively connecting to concrete members and securely moving or manipulating the members. Such manipulation, including lifting and securing of the panel, is facilitated through features and devices as shown and described herein. In one embodiment, the concrete member is a precast concrete wall panel or other structural device which is typically lifted with a crane or other machinery. One of skill in the art will recognize that when preformed panels and devices of the present disclosure are being manipulated or transmitted between various positions and/or orientations, it is desirable and often critical to establish a secure and safe connection between the panel or device and operational equipment. Additionally, however, it is also necessary to provide a system and device that allows for relative ease of removal of such operational equipment from the panel or device after transport or manipulation of the same is complete. Finally, the device must be designed to prevent damaging the wall panel or structure to avoid the necessity of costly repair and/or replacement.

The present disclosure contemplates various systems and methods for providing a void or access feature in a precast concrete structure. For example, U.S. Pat. No. 6,769,663 to Kelly et al., which is hereby incorporated by reference in its entirety, provides one such system suitable for use in connection with the present disclosure.

The oldest and most common type of void formers employ solid urethane blocks which have an undersurface of a generally arcuate configuration and a slot formed therein and extending into the undersurface for releasable receipt of the anchor. The blocks carry protrusions which extend across the slot to releasably engage the anchor. In use, the block is plastically deformed to engage and disengage the anchor. A recent variation of such an anchor wherein the slot is narrowed and defines a passage which complements the shape of the anchor is seen in U.S. Pat. No. 6,082,700, which is hereby incorporated by reference in its entirety. Earlier examples are found in U.S. Pat. Nos. 4,383,674, 4,821,994, 5,535,979, 5,651,911, and 7,950,190, all of which are hereby incorporated by reference in their entireties.

It is also well known in the art to provide hollow void formers for positioning anchors wherein the void formers have a smooth arcuate undersurface with a slot formed therein for receipt of the anchor. Such void formers, however, are relatively rigid and require some type of separate retaining element to secure the anchor within the slot. An example of such a void former can be found in U.S. Pat. No. 5,094,047, which is also incorporated herein by reference in its entirety.

In one embodiment of the present disclosure, a method of supporting a tilt-up wall panel is provided, the method comprising the steps of providing a pre-formed concrete wall panel, the wall panel comprising a pre-formed void and an embedded anchor member, the embedded anchor member disposed in and at least partially accessible via the void; providing a connector, or connector member, adapted to be selectively secured to a portion of the anchor member, the connector member comprising: a first planar portion adapted for substantially parallel placement with the wall panel, the first planar portion comprising an aperture for selectively receiving a fastener; a second planar portion and a third planar portion extending substantially perpendicular from the first planar portion, the second and third planar portions being substantially planar to each other; a partially enclosed void formed between the first planar portion, the second planar portion, and the third planar portion; a first arcuate member and a second arcuate member, said first and second arcuate members being substantially parallel to one another and arcuate about substantially the same axis; said first and second arcuate members defining a lower boundary of said partially enclosed void. A fastener is secured within said aperture such that said fastener extends linearly outward from said wall panel, and a support member for supporting the wall panel is secured to said fastener.

A contemplated method of forming the void former comprises providing a mold for injection molding a polymeric material into a body having first and second sections joined by a bridge therebetween and then removing the body from the mold and hinging the sections relative to one another through bending of the bridge, before the polymer is fully cured. In the preferred embodiment, the sections are molded in a condition where the first and second sections are separated and hingedly connected by the bridge. This enables a protruding latching device to be formed between the sections. After removal of the body from the form, and before the polymer has fully cured, the bridge is bent to alter its molecular structure and facilitate it for repeated usage as a hinge.

An object of the present disclosure is to provide a lifting apparatus, system and method for erecting panels. U.S. Pat. No. 6,260,900 to Scott, which is hereby incorporated by reference in its entirety, provides an anchor for use with ring clutches and bail lift clutches. Additionally, U.S. Pat. No. 4,634,164 to Fricker, U.S. Pat. No. 4,173,856 to Fricker, U.S. Pat. No. 4,437,642 to Holt, U.S. Pat. No. 4,700,979 to Courtois and U.S. Pat. No. 4,671,554 to Lancelot disclose lifting means and are hereby incorporated by reference in their entireties.

Various anchors are contemplated for use in connection with additional system components. In one embodiment, for example, an anchoring member is provided comprising a shaft portion with a first end and a second end, the first end comprising a first flange and the second end comprising a second flange. An example of one such anchoring member is the DB-52 dogbone anchor provided by MEADOW-BURKE®. Such anchoring members may be referred to herein as "dogbone anchors" or "anchors."Various alternative anchors are also contemplated for use by connector members of the present disclosure.

In various embodiments, a connector member for interconnection to an anchor member is provided. Connector members of the present disclosure include connector members adapted for selectively attaching to and being removable from a pre-existing anchor, such as a "dogbone" shaped anchor. Connector members of the present disclosure comprise dimensions which facilitate connection to an anchor member and facilitate entry or placement into a pre-formed void. Various embodiments contemplate a connector member with substantially parallel side walls to be received within sidewalls of a void, and arcuate members to facilitate rotational entry, or rotatable interconnection, of the connector member into a space defined by the void in a wall panel. Connector members of the present disclosure are useful for various operations, including, but not limited to lifting, translocating, and support wall panels.

Connector members of the present disclosure may comprise any one or more known materials suitable for transmitting force, moving, and/or supporting precast concrete structures. Such materials include, but are not limited to, various ferrous alloys, cast steels, and similar materials.

In one embodiment, a connector member adapted for interconnection to an anchor provided in a precast concrete panel is provided, the connector member comprises a first planar portion adapted for substantially parallel placement with the precast concrete panel, the first planar portion comprising a threaded aperture for selectively receiving a fastener such as a bolt, a second planar portion and a third planar portion extending substantially perpendicular from the first planar portion, the first and second planar portions being substantially parallel to each other, a partially enclosed void formed between the first planar portion, the second planar portion, the third planar portion, a first arcuate member and a second arcuate member, the first and second arcuate members being substantially parallel to one another and arcuate about substantially the same axis, and the first and second arcuate members defining a lower boundary of the partially enclosed void and configured to receive and engage an anchor or other hardware with a predetermined shape.

It is another aspect of the present invention to provide a method of supporting a tilt-up wall panel, the method comprising the steps of providing a precast concrete wall panel, the wall panel comprising a pre-formed void and an embedded anchor member, the embedded anchor member disposed in and at least partially accessible via the void; providing a connector member adapted to be selectively secured to a portion of the anchor member, the connector member comprising a first planar portion adapted for substantially parallel placement with the wall panel, the first planar portion comprising an aperture for selectively receiving attachment hardware; a second planar portion and a third planar portion extending substantially perpendicular from the substantially planar portion, the second and third planar portions being substantially parallel to each other; a partially enclosed void formed between the first planar portion, the second planar portion, and the third planar portion; a first arcuate member and a second arcuate member, the first and second arcuate members being substantially parallel to one another and arcuate about substantially the same axis; the first and second arcuate members defining a lower boundary of the partially enclosed void; securing a fastener positioned within the aperture; and securing a support member for supporting the wall panel to the fastener.

Further, it is an aspect of this invention to provide the above-described method wherein the support member comprises a wall brace. Further yet, the above-described method is provided wherein the support member is at least partially secured by an adjustment member, the adjustment member provided on said fastener and translatable along a length of the fastener. Still further, the above-described method is provided wherein the fastener extends linearly outward from the wall panel.

These and other objects will become more apparent from the accompanying drawings and the following detail description.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
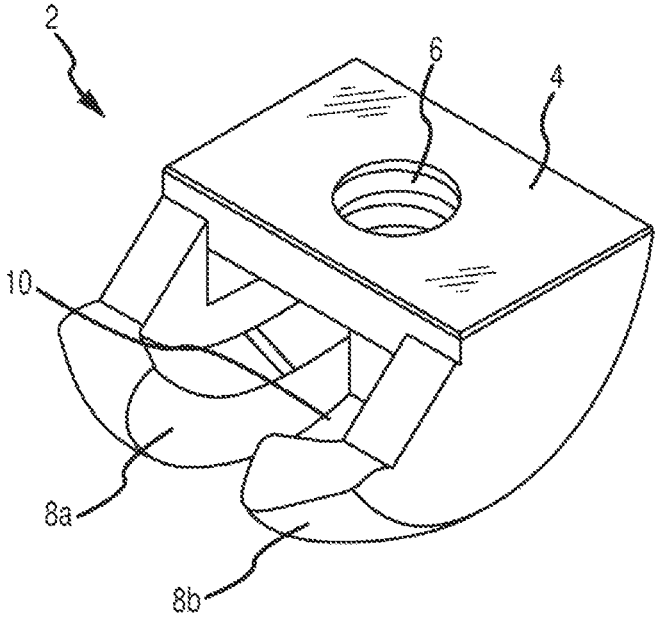
FIG. 1 is perspective view of one embodiment of a connector member.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

To assist in the understanding of the present disclosure the following list of components and associated numbering found in the drawings is provided herein:

| # | Component |
|---|---|
| 2 | Connector Member |
| 4 | First Planar Portion |
| 6 | Threaded Aperture |
| 8a | First Arcuate Member |
| 8b | Second Arcuate Member |
| 10 | Partially Enclosed Void |
| 12 | Anchor Member |
| 14 | First Flange |
| 16 | Anchor Shaft |
| 18 | Second Flange |
| 20 | Concrete Structure |
| 22 | Fastener |
| 24 | Adjustment Member |
| 26 | Brace |
| 30 | Rearward Portion |
| 32 | Stop |
| 34 | Inclined Ramp |

DETAILED DESCRIPTION

FIG. 1 is a perspective view of a connector member 2 according to one embodiment of the present disclosure. The connector member 2 comprises a first planar portion 4 adapted to be positioned flush with a wall or other precast structure. The first planar portion 4 comprises a threaded aperture 6 adapted to receive additional components such as a threaded bolt or other similar hardware. Although the threaded aperture 6 is depicted as being positioned in a central location on the first planar portion 4, the present disclosure is not limited to that particular configuration. It is contemplated that the threaded aperture 6 may be provided in any number of suitable locations. The connector member 2 further comprises a first arcuate member 8*a* and a second arcuate member 8*b*. First and second arcuate members 8*a*, 8*b* selectively receive an anchor member, such as a dogbone anchor preformed or embedded in a concrete structure. Dogbone anchors include, for example, the commercially available DB-52 dogbone anchors provided by MEADOWBURKE®. A flange or lifting end of the dogbone anchor member is received by first and second arcuate members 8*a*, 8*b* of the connector member 2 such that the connector member 2 and any associated components are in force-transmitting communication with a dogbone anchor member and any associate concrete structure (e.g. panel).

First and second arcuate members 8*a*, 8*b* comprises substantially parallel arcuate members which generally define a partially enclosed void 10. Partially enclosed void 10 receives various features, such as flanges or force-transmitting portions of an anchor as will be described in more detail herein.

FIGS. 2-5 provide various dimensions (in inches) of a particular embodiment of a connector member. Dimensions provided in FIGS. 2-5 are merely for additional support and clarity of the present disclosure. Various sizes and proportions of connector members are contemplated by the present disclosure and the dimensions provided herein shall be viewed as merely exemplary.

Figure 2:
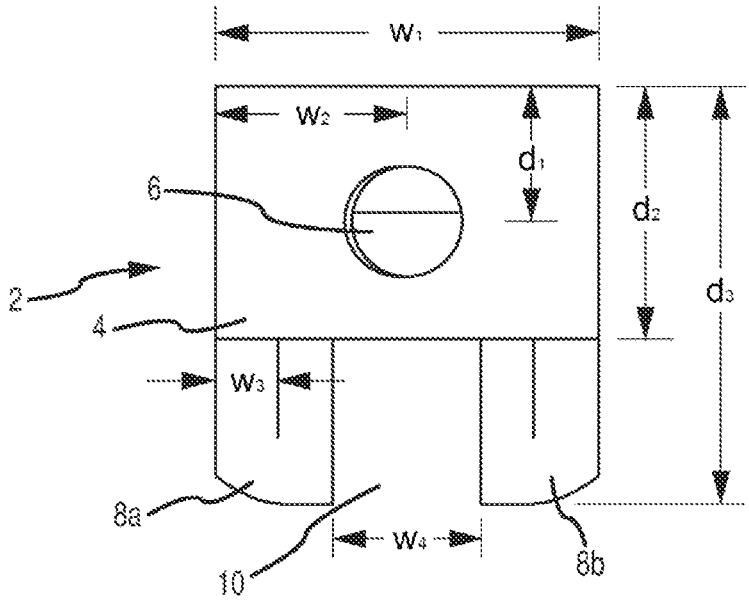
FIG. 2 is a top plan view of one embodiment of a connector member.

FIG. 2 is a top plan view of one embodiment of a connector member 2. FIG. 2 provides various dimensions (in inches) of the particular embodiment. $d_1$ represents the distance between one side of the first planar portion 4 to the center of the aperture 6. In various embodiments, $d_1$ is between approximately 0.1 inches and 2.0 inches. In preferred embodiments, $d_1$ is between approximately 0.7 inches and 0.9 inches. $d_2$ represents the depth of the first planar portion 4. In various embodiments, $d_2$ is between approximately 0.5 inches and 4.0 inches. In preferred embodiments, $d_2$ is between approximately 1.35 inches and 1.65 inches. $d_3$ represents the overall depth of the connector member 2. In various embodiments, $d_3$ is between approximately 1 inch and 6 inches. In preferred embodiments, $d_3$ is between approximately 2.2 inches and 2.7 inches.

$w_1$ represents the overall width of the connector member 2. In various embodiments, $w_1$ is between approximately 1.0 and 6.0 inches. In preferred embodiments, $w_1$ is between approximately 2.0 inches and 2.5 inches. $w_2$ represents the distance between one edge of the first planar portion 4 and the center of aperture 6. In various embodiments, $w_2$ is between approximately 0.1 and 2.0 inches. In preferred embodiments $w_2$ is between approximately 1.0 inch and 1.3 inches. $w_3$ represents the spacing between first and second arcuate members 8*a*, 8*b*. In various embodiments, $w_3$ is between approximately 0.1 inch and 2.0 inches. In preferred embodiments, $w_3$ is between approximately 0.8 inches and 1.0 inch. $w_4$ represents the distance between one edge of first and second arcuate members 8*a*, 8*b* and the start of an inclined ramp. In various embodiments, $w_4$ is between approximately 0.05 inches and 1.00 inch. In preferred embodiments, $w_4$ is between approximately 0.30 inches and 0.45 inches.

Figure 3:
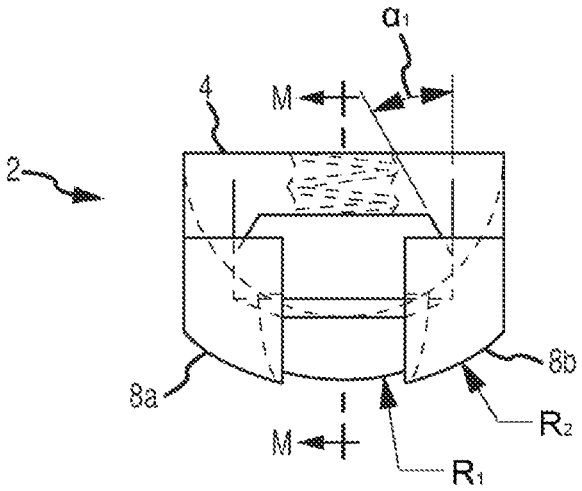
FIG. 3 is a front elevation view of the connector member of the embodiment of FIG. 2.

FIG. 3 is a front elevation view of the connector member 2 according to the embodiment of FIG. 2. The first and second arcuate members 8*a*, 8*b* comprise a bottom surface that has a radius of curvature, $R_1$. In the depicted embodiment, $R_1$ is approximately 1.688 inches. In various embodiments, $R_1$ is between approximately 0.5 inches and 4.0 inches. In preferred embodiments, $R_1$ is between approximately 1.50 inches and 1.75 inches, such that the connector member 2 fits at least partially within a preformed void in a concrete structure. Further, the connector member 2 has a bottom surface with a radius of curvature $R_2$. In various embodiments, R2 is between approximately 0.5 inches and 4.0 inches. In preferred embodiments, R1 is between approximately 1.50 inches and 1.75 inches. Lastly, the first planar portion 4 transitions to the remaining elements of the connector member 2 at angle $\alpha_1$. In various embodiments, $\alpha_1$ is between approximately 0 degrees and 90 degrees. In preferred embodiments, $\alpha_1$ is between approximately 26 degrees and 32 degrees.

Figure 4:
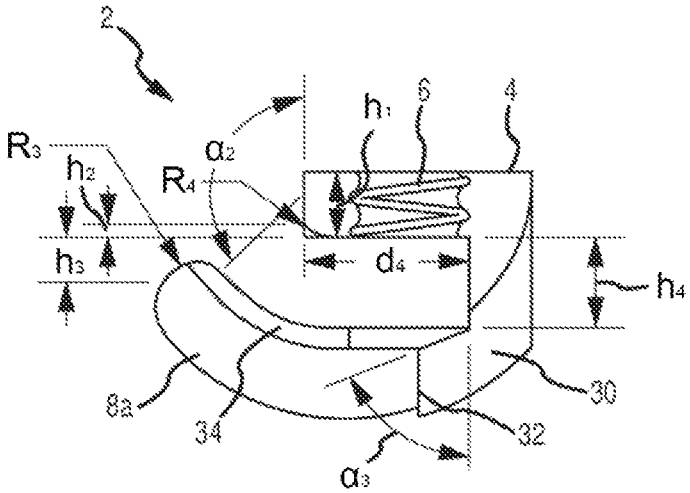
FIG. 4 is a cross-sectional side elevation view of the connector member of the embodiment of FIG. 2.

FIG. 4 is a cross-sectional side elevation view of a connector member 2 along section line M-M (see FIG. 3). The first arcuate member 8*a* extends from a rearward portion 30 of the connector member 2. The rearward portion 30 of the connector member 2 extends between arcuate members and comprises a stop 32, which serves to limit rotation of the connector member 2. Accordingly, connector member 2 receives a flange portion of an anchor by rotating the connector member 2 into position. Removal of the connector member 2 from additional system components is accomplished by a reverse rotation. When provided in connection with an anchor, connector member 2 is capable of transmitting force to the anchor in substantially all vectors, axis, etc., with the exception of the arcuate removal motion described above (i.e. reverse rotation with respect to an installation motion). When installed, the connector member 2 is capable of transmitting forces to the anchor and associated panel or structure. Such forces include, but are not limited to shear forces, rotational forces, tension forces, and compression forces in various directions. A properly connected connector member 2 may thus be used to lift, rotate, move, and/or stabilize a panel, such as a preformed concrete tilt-up panel.

Inclined ramps 34 are provided on internal surfaces of the first and second arcuate members 8*a*, 8*b*. Inclined ramps 34 may be provided at any number of desired angles and are provided to contact a taper or angle of a first flange member (see, e.g., 14 of FIG. 6).

FIG. 4 provides various dimensions (in inches) of the particular embodiment. $h_1$ represents the height of the first planar portion 4. In various embodiments, $h_1$ is between approximately 0.05 inches and 1.25 inches. In preferred embodiments, $h_1$ is between approximately 0.39 inches and 0.47 inches. $h_2$ is the distance between the bottom surface of the first planar portion 4 and the bevel of one edge of the first planar portion 4. In various embodiments, $h_2$ is between approximately 0.01 inches and 0.50 inches. In preferred embodiments, $h_2$ is between approximately 0.08 inches and 0.10 inches. $h_3$ is the distance between the bottom surface of the first planar portion 4 and the leading edge of the first arcuate member 8*a*. In various embodiments, $h_3$ is between approximately 0.03 inches and 1.00 inch. In preferred embodiments, $h_3$ is between approximately 0.25 inches and 0.32 inches. $h_4$ is the distance between the bottom surface of the first planar portion 4 and the top surface of arcuate member 8*a*. In various embodiments, $h_4$ is between approximately 0.1 inches and 1.5 inches. In preferred embodiments, $h_4$ is between approximately 0.55 inches and 0.65 inches. $d_4$ is the distance between the one edge of the first planar portion 4 and a surface of the rearward portion 30. In various embodiments, $d_4$ is between approximately 0.2 inches and 2.5 inches. In preferred embodiments, $d_4$ is between approximately 0.9 inches and 1.1 inches.

$R_3$ is the radius of curvature of the leading edge of the first arcuate member 8*a*. In various embodiments, $R_3$ is between approximately 0.1 inches and 2.0 inches. In preferred embodiments, $R_3$ is between approximately 0.29 inches and 0.35 inches. $R_4$ is the radius of curvature of the bevel of one edge of the first planar portion 4. In various embodiments, $R_4$ is between approximately 0.1 inches and 2.5 inches. In preferred embodiments, $R_4$ is between approximately 0.39 inches and 0.47 inches. $\alpha_2$ is the angle between the leading edge of the first arcuate member 8*a* and a vertical plane. In various embodiments $\alpha_2$ is between approximately 175 degrees and 95 degrees. In preferred embodiments, $\alpha_2$ is between approximately 120 degrees and 150 degrees. $\alpha_3$ is the angle between a surface of the rearward portion 30 and a vertical plane. In various embodiments, $\alpha_3$ is between approximately 90 degrees and 0 degrees. In preferred embodiments, $\alpha_3$ is between approximately 75 degrees and 61 degrees.

Figure 5:
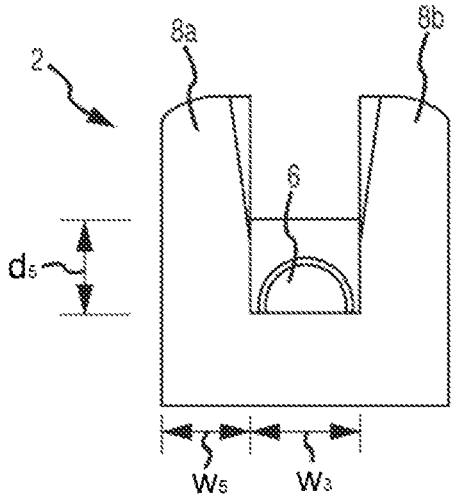
FIG. 5 is a bottom plan view of the connector member of the embodiment of FIG. 2.

FIG. 5 is a bottom plan view of the connector member 2 according the embodiment shown in FIGS. 2-4. A gap is provided between the first arcuate member 8*a* and the second arcuate member 8*b* to receive an anchor shaft. FIG. 5 provides various dimensions (in inches) of the particular embodiment. $w_3$, as mentioned above, is the spacing between first and second arcuate members 8*a*, 8*b*. $w_5$ is the width of each the first arcuate member 8*a* and the second arcuate member 8*b*. In various embodiments, $w_5$ is between approximately 0.1 inches and 2.0 inches. In preferred embodiments, $w_5$ is between approximately 0.6 inches and 0.8 inches. $d_5$ is the distance between one edge of the first planar portion 4 and a surface of the rearward portion 30. In various embodiments, $d_5$ is between approximately 0.2 inches and 2 inches. In preferred embodiments, $d_5$ is between approximately 0.8 inches and 1.0 inches.

Figure 6:
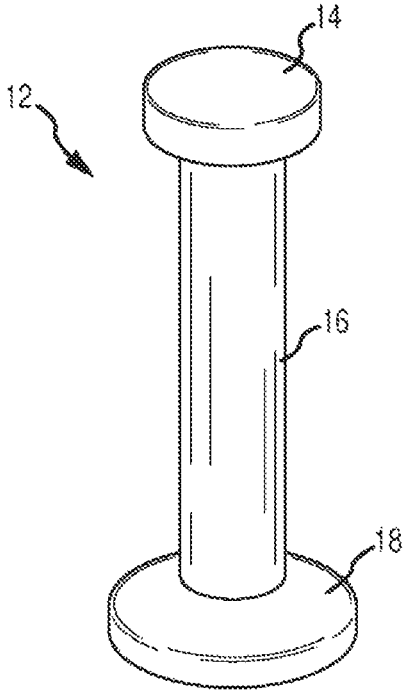
FIG. 6 is an isometric view of an anchor member contemplated for use with embodiments of the present disclosure.

FIG. 6 depicts a dogbone anchor member 12 contemplated for use with various features of the present disclosure. As shown, the anchor member 12 comprises a first flange 14, an elongate substantially cylindrical anchor shaft 16 and a second flange 18. Second flange 18 is adapted for placement within a preformed concrete structure. First flange 14 is provided for interconnection to various objects including, for example, being received within partially enclosed void 10 of a connector member 2. The dogbone anchor member 12 or other types of lifting hardware may be considered a permanent or semi-permanent installation within a body of pre-formed concrete. The dogbone anchor member 12 is thus adapted to transmit force to a connected panel or pre-formed concrete structure as may be required or desired in lifting, movement, securing, etc. of the panel.

Figure 7:
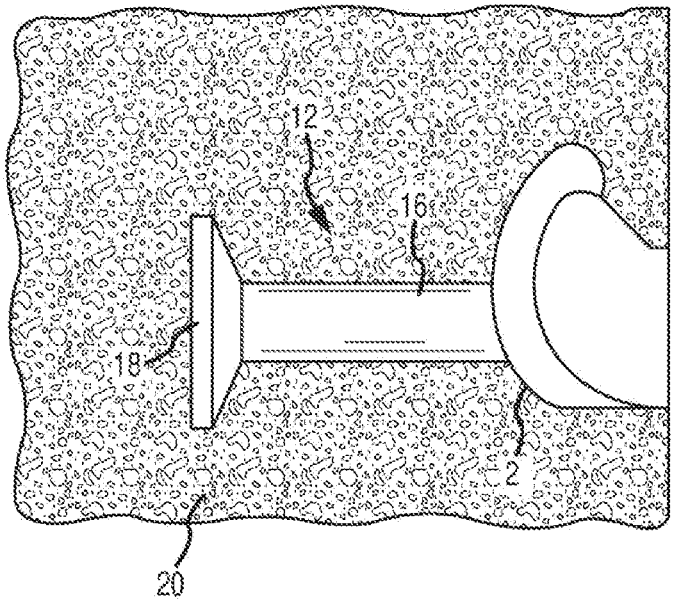
FIG. 7 is a partial cross sectional view of a system according to one embodiment of the present disclosure.

FIG. 7 depicts a dogbone anchor member 12 embedded in a mass of concrete structure 20 or other similar type of precast wall panel. The partial cross sectional view of FIG. 7 shows the anchor member 12 and connector member 2 at different cross sections in the concrete structure 20 while not showing the precast void in the concrete structure 20. One skilled in the art will appreciate the partial cross sectional view's presentation of various components to aid in visualization of the anchor member 12 and connector member 2. The second flange 18 and the shaft 16 of the anchor member 12 are formed or set in the concrete structure 20. A connector member 2 is selectively attached to an end of the anchor member 12 accessible via a pre-formed void in the concrete structure 20. The anchor is rotated or pivoted into position whereby the connector member 2 substantially surrounds a first flange 14 of the anchor member 12 such that the anchor member 12 is selectively positionable between the state of force-transmitting communication with the panel 20 and a removed state.

Figure 8:
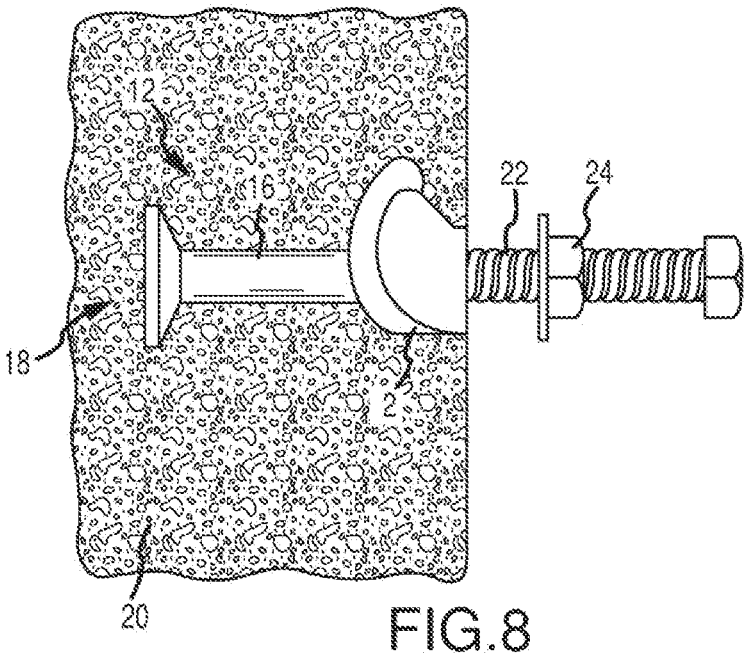
FIG. 8 is a partial cross sectional view of a system according to one embodiment of the present disclosure.

FIG. 8 is a partial cross sectional view of an anchor member 12 with interconnected connector member 2. The partial cross sectional view of FIG. 8 shows the anchor member 12 and connector member 2 at different cross sections in the concrete structure 20 while not showing the precast void in the concrete structure 20. One skilled in the art will appreciate the partial cross sectional view's presentation of various components to aid in visualization of the anchor member 12 and connector member 2. The connector member 2 is provided with fastener 22 which is threadably received by the threaded aperture 6. Fastener 22 comprises additional adjustment member 24, adjustment member 24 in this particular embodiment comprises a nut and washer arrangement. Fastener 22 and associated adjustment member 24 extend away from the connector member 2 and panel 20 and provide means for connecting or securing additional features to the system. For example, known wall braces may be selectively connected to the fastener 22 to support and/or move the panel 20.

Figure 9:
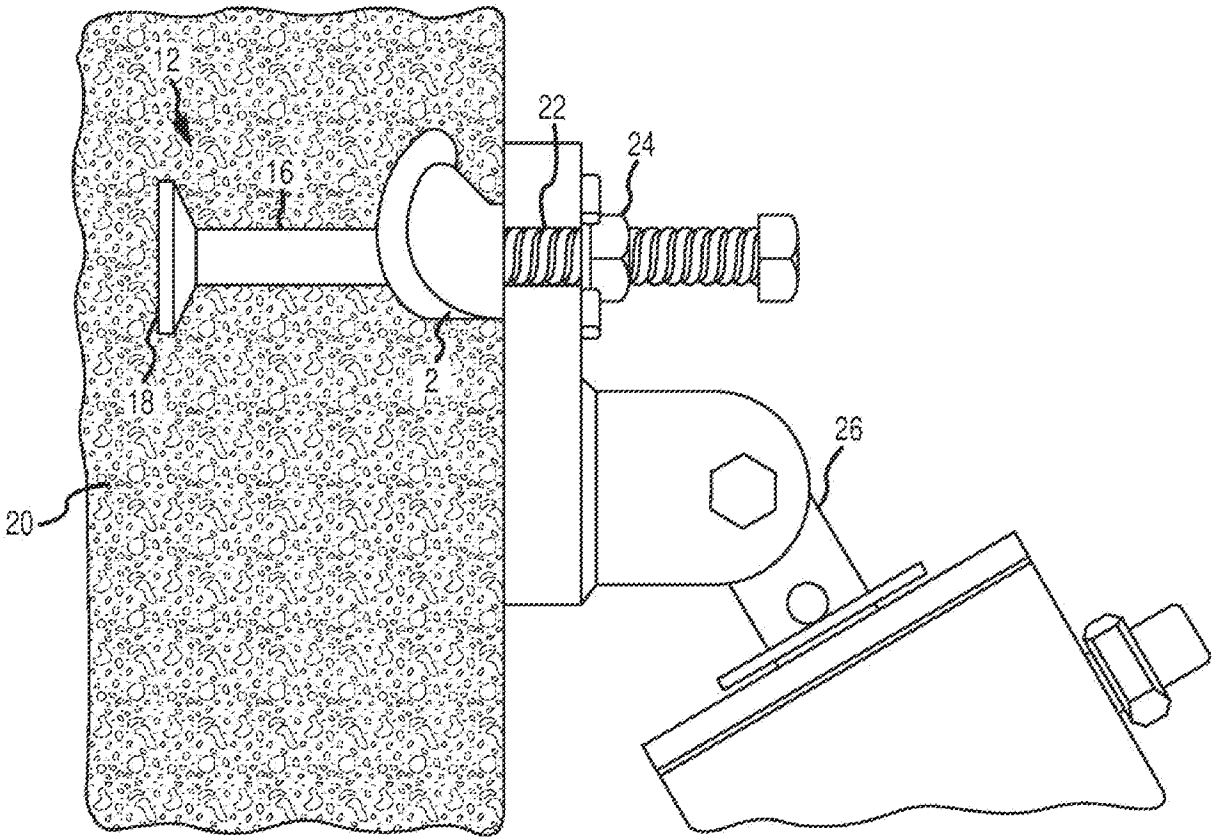
FIG. 9 is a partial cross sectional view of the embodiment of FIG. 8.

FIG. 9 depicts the embodiment of FIG. 8 wherein a wall brace 26 is secured to the fastener 22. The partial cross sectional view of FIG. 9 shows the anchor member 12 and connector member 2 at different cross sections in the concrete structure 20 while not showing the precast void in the concrete structure 20. One skilled in the art will appreciate the partial cross sectional view's presentation of various components to aid in visualization of the anchor member 12 and connector member 2. As shown, the brace 26 contacts the panel 20 and is secured thereto by interconnection with fastener 22. Adjustment member 24 is provided to aid in securing the brace 26 to the panel 20 and fastener 22, which is in turn connected to the connector member 2. FIG. 9 thus depicts a system whereby the wall brace 26 may be temporarily and securely connected to the connector member 2 and associated panel 20.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A connector member for selective interconnection to an anchor member provided in a precast concrete structure, the connector member comprising:

a first planar portion comprising a threaded aperture;

a fastener provided in and selectively removable from the threaded aperture, wherein the fastener extends substantially perpendicularly from the first planar portion;

an adjustment member provided on the fastener, the adjustment member comprising a nut adapted to secure at least one additional feature to the connector member;

a second planar portion and a third planar portion extending substantially perpendicular from said first planar portion, said second and third planar portions being substantially parallel to each other;

a first arcuate member and a second arcuate member extending from said second and third planar portions, respectively, said first and second arcuate members being substantially parallel to one another and arcuate about substantially the same axis;

a stop provided between the first arcuate member and the second arcuate member, the top adapted to limit rotation of the connector member about the anchor member; and a partially enclosed void formed between said first planar portion, said second planar portion, said third planar portion, and said first and second arcuate members.

2. The connector member of claim 1, wherein said first and second arcuate members comprise inclined ramps for communicating with a flange of said anchor member.

3. The connector member of claim 1, wherein said fastener comprises a threaded bolt.

4. The connector member of claim 1, wherein said fastener comprises a threaded fastener extending from said aperture, said threaded fastener comprising the adjustment member for securing the additional feature to said threaded fastener.

5. The connector member of claim 4, wherein at least one of a wall brace and strut is secured to said threaded fastener by said adjustment member.

6. The connector member of claim 1, further comprising a rearward portion extending between said first and second arcuate members, said rearward portion adapted to limit rotation of said connector member about a flange of said anchor member.

7. The connector member of claim 1, wherein said first planar portion is adapted for substantially planar placement with a surface of said precast concrete structure.

8. The connector member of claim 1, further comprising a precast concrete panel comprising a void, wherein an anchor member is disposed in said void.

9. A connector member for selective interconnection to an anchor member provided in a precast concrete structure, said connector member comprising:

a first planar portion adapted for substantially parallel placement with a surface of said precast concrete structure, said first planar portion comprising a threaded aperture;

a fastener provided in and selectively removable from the threaded aperture, wherein the fastener extends substantially perpendicularly from the first planar portion;

a second planar portion and a third planar portion extending substantially perpendicular from said first planar portion, said second and third planar portions being substantially parallel to each other;

a first arcuate member and a second arcuate member extending from said second and third planar portions, respectively, said first and second arcuate members being substantially parallel to one another and arcuate about substantially the same axis, wherein said first and second arcuate members comprise inclined ramps for communicating with a flange of said anchor member;

a rearward portion extending between said first and second arcuate members, said rearward portion adapted to limit rotation of said connector member about a flange of said anchor member; and a partially enclosed void formed between said first planar portion, said second planar portion, said third planar portion, said rearward portion, and said first and second arcuate members.

10. The connector member of claim 9, wherein said fastener comprises a threaded bolt.

11. The connector member of claim 9, wherein said first and second arcuate members comprise a bottom surface with a radius of curvature, said radius of curvature is between approximately 0.5 inches to approximately 4.0 inches.

12. The connector member of claim 9, wherein said first and second arcuate members comprise a bottom surface with a radius of curvature, said radius of curvature is between approximately 1.50 inches to approximately 1.75 inches.

13. The connector member of claim 9, wherein said first and second arcuate members comprise a bottom surface with a radius of curvature, said radius of curvature is approximately 1.688 inches.

14. A system for selective interconnection to a preexisting anchor member provided in a precast concrete wall panel, the system comprising:

a connector member for interfacing with a preexisting anchor member, the connector member comprising:

(i) a first planar portion comprising a threaded aperture;

(ii) a second planar portion and a third planar portion extending substantially perpendicular from said first planar portion, said second and third planar portions being substantially parallel to each other;

(iii) a first arcuate member and a second arcuate member extending from said second and third planar portions, respectively, said first and second arcuate members being substantially parallel to one another and arcuate about substantially the same axis;

(iv) a partially enclosed void formed between said first planar portion, said second planar portion, said third planar portion, and said first and second arcuate members;

a threaded fastener selectively connected with said threaded aperture, said threaded fastener comprising a length, said threaded fastener partially disposed in and extending from said aperture; and a support member comprising at least one of a wall brace and a strut, said support member selectively interconnected to said threaded fastener.

15. The connector member of claim 14, wherein said threaded fastener extends substantially perpendicular to said first planar portion.

16. The connector member of claim 14, further comprising an adjustable member wherein said adjustable member is provided on said threaded fastener, and wherein said adjustable member is translatable along said length of said threaded fastener.

17. The connector member of claim 16, wherein said adjustable member is selectively translated to secure said support member to said threaded fastener.

* * * * *